United States Patent [19]

Merritt et al.

[11] Patent Number: 4,499,334

[45] Date of Patent: Feb. 12, 1985

[54] HEAT RESISTANT SHEATHED INSULATED ELECTRICAL CONDUCTORS

[75] Inventors: Francis L. Merritt, Redondo Beach; Adriano C. Ducati, Corona del Mar, both of Calif.

[73] Assignee: The United States of America as represented by the Secretary of the Air Force, Washington, D.C.

[21] Appl. No.: 564,547

[22] Filed: Dec. 22, 1983

[51] Int. Cl.[3] ..... H01B 7/00

[52] U.S. Cl. ..... 174/111; 174/102 R; 174/110 R; 174/178; 219/523; 219/541; 219/550; 338/214; 338/213; 338/302

[58] Field of Search ..... 219/523, 270, 532, 538, 219/541, 550, 552; 338/213, 214, 286, 302; 174/111, 110 R, 113 R, 178, 115, 102 R, 110 AR, 110 SR, 110 PM; 156/48; 428/389; 525/291

[56] References Cited

U.S. PATENT DOCUMENTS

| | | | |
|---|---|---|---|
| 1,019,075 | 3/1912 | Nuckols et al. | 338/286 X |
| 1,612,220 | 12/1926 | Ravella | 219/541 X |
| 1,927,035 | 9/1933 | Hicks | 338/214 X |
| 1,974,302 | 9/1934 | Finlayson | 219/538 |
| 2,173,539 | 9/1939 | Peters et al. | 174/111 X |
| 2,387,829 | 10/1945 | Burnham et al. | 338/214 |
| 2,639,359 | 5/1953 | Glenn | 338/214 |
| 2,884,509 | 4/1959 | Heath | 338/210 X |
| 3,028,447 | 4/1962 | Flaschen et al. | 174/113 R |
| 3,031,522 | 4/1962 | Clark et al. | 174/102 R |
| 3,045,097 | 7/1962 | Sellers | 219/541 X |
| 3,109,053 | 10/1963 | Ahearn | 174/110 A |
| 3,121,038 | 2/1964 | Perotte | 156/48 |
| 3,476,915 | 11/1969 | Rapsis | 219/523 |
| 3,697,671 | 10/1972 | Parker | 174/115 |
| 4,125,509 | 11/1978 | Vostovich | 525/291 |
| 4,145,475 | 3/1979 | Vostovich | 428/389 |
| 4,345,555 | 8/1982 | Oshima et al. | 219/270 X |

FOREIGN PATENT DOCUMENTS

| | | | |
|---|---|---|---|
| 343358 | 10/1904 | France | 338/213 |
| 532178 | 1/1922 | France | 174/178 |
| 358182 | 10/1931 | United Kingdom | 219/550 |
| 946599 | 1/1964 | United Kingdom | 174/111 |

*Primary Examiner*—Volodymyr Y. Mayewsky
*Attorney, Agent, or Firm*—Donald J. Singer; Bernard E. Franz

[57] ABSTRACT

The leads to a heater for an electrothermal hydrazine monopropellant thruster comprise tungsten conductors wrapped with smaller diameter tungsten support wire and insulated with beads of alumina ($Al_2O_3$). A transition section connects the leads to regular leads. An attaching support wire is attached to the heater at one end and to the transition section at the other end. The insulated conductors and attaching wire are wrapped together with nickel ribbon to form a sheath.

3 Claims, 4 Drawing Figures

HEAT RESISTANT SHEATHED INSULATED ELECTRICAL CONDUCTORS

RIGHTS OF THE GOVERNMENT

The invention described herein may be manufactured and used by or for the Government of the United States for all governmental purposes without the payment of any royalty.

BACKGROUND OF THE INVENTION

This invention relates to heat resistant sheathed insulated electrical conductors, and more particularly to a flexible heat resistant cable.

Satellites in space may include thrusters of various types. One type of monopropellant thruster is an electrothermal hydrazine engine. A basic requirement is to provide a high efficiency, long life monopropellant thruster. A decomposition chamber heater is required to maintain the temperature above 900° F. If the temperature falls below 800° F., the hydrazine would not decompose and the liquid would pass through the thruster undecomposed (i.e., chamber has flooded out). The heater itself is required to have a peak temperature of 2000° F. The electrical leads adjacent to the heater comprise conductors, insulation, and a metal sheath which are heat resistant. A typical construction for the leads has been tungsten or platinum conductors, magnesia (MgO) insulation, and a sheath of columbiam or platinum. Among the problems experienced by electrothermal heaters was shorting of the heater because of damaged heater leads.

SUMMARY OF THE INVENTION

An object of the invention is to provide reliable heat-resistant heater leads having some flexibility.

The leads according to the invention comprise tungsten electrical conductors insulated with alumina beads, a heavy support wire of tungsten or molybdenum being parallel to the insulated conductors, and the insulated conductors being wrapped with a helical wound ribbon outer sheath of a metal such as nickel.

DETAILED DESCRIPTION

Figure 1:
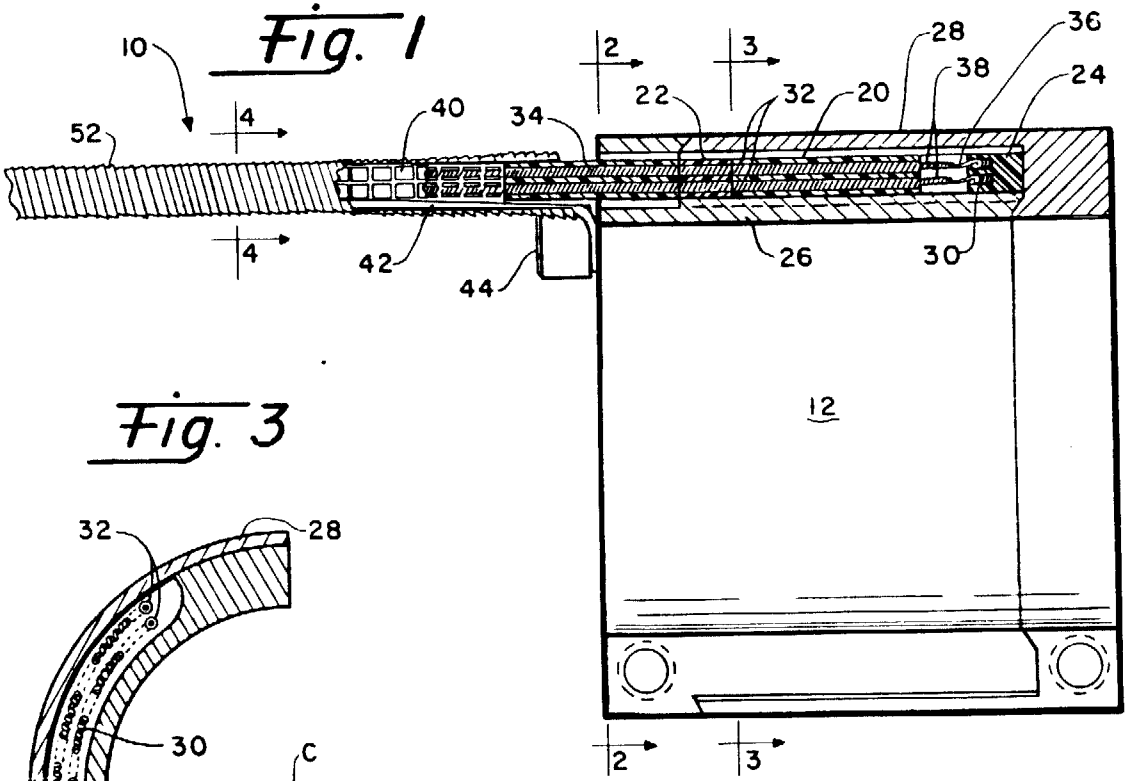
FIG. 1 is a longitudinal view of a lead arrangement from a heater to a transitional section, partly broken away and partly sectioned.
Figure 3:
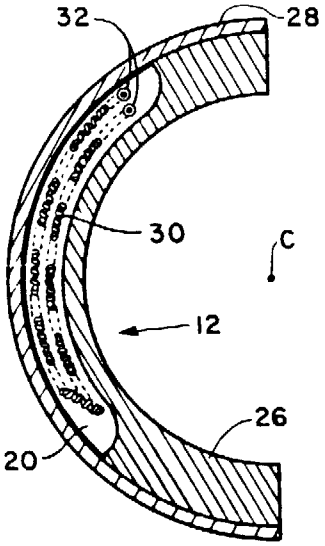
FIG. 3 is a sectional view of the heater along lines 3—3 of FIG. 1.
Figure 2:
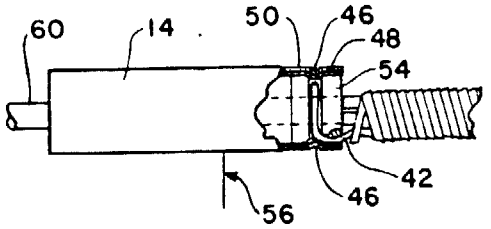
FIG. 2 is a left end view of the heater shown in FIG. 1, with the exit insulator for the leads sectioned, along lines 2—2 of FIG. 1.
Figure 2:
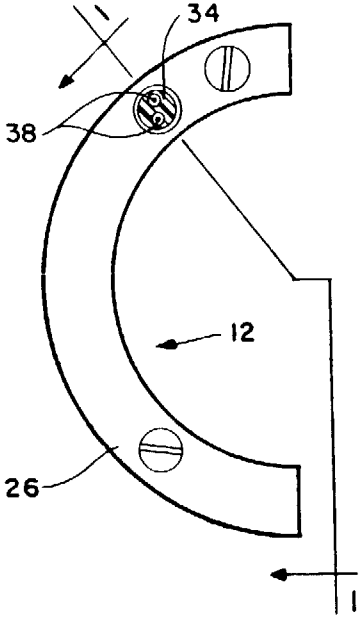

The drawing in FIG. 1 shows the heat-resistant electrical lead arrangement 10 connected between a heater 12 and a transition connector 14. FIG. 2 is a left-end view of the heater 12 along lines 2—2 of FIG. 1, and FIG. 3 is a sectional view along lines 3—3 of FIG. 1. The view of the heater in FIG. 1 is partly sectioned, along lines 1—1 of FIG. 2. Two heaters (each of the type shown in the drawing) are used together in the form of an annulus/clamshell unit, as an electrothermal decomposition hydrazine thruster heater unit, which is attached to a cylindrical body.

The heater 12 comprises a main insulator 20, a lead access block 22, an end block 24, an inner case 26, an outer case 28, the heating wire coil 30, and assembly screws, two of which are shown in FIG. 2. The main insulator, lead access block, and end block are boron nitride (BN). The inner and outer cases are TZM arc cast molybdenum. The overall outer diameter is 1.500 inches, and the inner diameter is 1.076 inches. The main insulator 20 has an inner radius of 0.578 inch, an outer radius of 0.703 inch, and forms an arc of 110 degrees, all measured from the center C shown in FIG. 3.

There are eighteen holes of 0.033 inch diameter through the main insulator (left-to-right in FIG. 1) for the heater coil 30, and two holes 32 of 0.025 inch diameter for the lead wires. These lead holes extend on through the lead access block 22, and an alumina ceramic exit insulator 34. The exit insulator (FIGS. 1 and 2) is 0.093 inch outer diameter, and 0.400 inch long, half being in a hole of the inner case 26. The lead holes through the heater 10 are shown in FIG. 1 on the same cross section for convenience, but as shown in FIGS. 2 and 3 they are actually located at slightly different cross sections. The lead access and end blocks have grooves which overlay the coil holes of the main insulator to pass the sections of coil between the holes.

The heater wire 30 may be a tungsten 25% rhenium alloy 0.005 inch diameter, 29.5 inches long, with a design resistance of 39.2 ohms at 1000° F., and a room temperature resistance of about 19 ohms, to provide about 20 watts heater power at 28 volts DC. This wire may be continued through to the connector 14 to provide the leads, or separate leads may be spot welded to the heater coil at point 36. In either case, the heater coil turns stop at point 36. The leads 38 are wrapped with 0.003 inch tungsten support wires from just past point 36 to within the connector 14.

Figure 4:
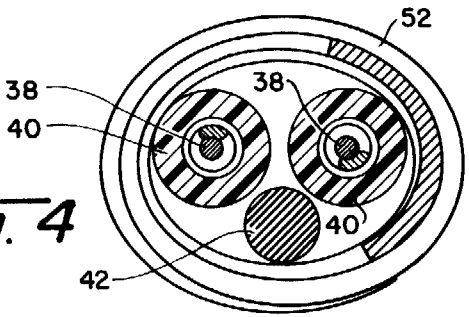
FIG. 4 is a cross-section view of the lead arrangement.

To form the lead arrangement 10, the lead wires 38 are individually insulated with beads 40. These beads are 0.05 inch long, 0.02 inch inner diameter, 0.035 inch outer diameter, and the material of 0.998 alumina ($Al_2O_3$). A 0.02 inch diameter attaching wire 42 of molybdenum or tungsten runs parallel to the insulated conductors, as a support for the lead arrangement 10. The wire 42 is attached to the heater 12 with a 2-56 holding screw 44 of TZM molybdenum. At the other end the wire 42 is wrapped one turn around a neck (reduced outer diameter) of a collar 54. The case of the connector 14 is crimped at four places 46 into the neck of the collar 54. The case comprises an inner case 48 and an outer case 50. The lead arrangement 10 is sheathed with a wrapping of 0.007 by 0.030 nickel ribbon, using overlap turns. The wrap starts adjacent the screw 44 with a tuck under the attaching wire 42 and continues around the exit insulator 34, and then around the beads 40 of both conductors and the wire 42. The cross section of the lead arrangement 10 away from the ends may be as shown enlarged in FIG. 4, Within the connector 14 the conductors 38 are brazed to a 2-conductor set of leads 60. The length of the lead arrangement 10 is 3.00 inches from the heater 12 to point 56 in the connector 14. In FIGS. 2 and 3 the cross section of the conductors 38 appear as black dots because of the small scale, but would appear as in FIG. 4 if enlarged. The cross section of each of these conductors is a straight center wire wrapped with a smaller diameter wire, within a hole. In FIG. 2 the holes are in the insulator tube 34, in FIG. 3 the holes 32 are in the main insulator 20, and in FIG. 4 the holes are in the insulator beads 40.

In an alternative embodiment, the attaching wire 42 and nickel wrap 52 are omitted, and instead the leads with beads 40 are individually sheathed with platinum 20% rhenium tubing having a 0.050 outer diameter. The exit insulator 34 is shortened to flush with the heater case 26, and a flange plate is attached to the case 26 with screw 44. The flange plate has holes for the beads 40. The two sheath tubes are microarc brazed to the flange plate, and at the other end to a modified collar of the connector 14. The tubes extend into the collar for 0.08 inch. At the ends of the tubes, the holes of the collar are reduced to a 0.038 inch diameter to clear the beads 40.

Thus, while preferred constructional features of the invention are embodied in the structure illustrated herein, it is to be understood that changes and variations may be made by the skilled in the art without departing from the spirit and scope of our invention.

We claim:

1. An electrical lead arrangement for a heater, said lead arrangement comprising:

lead conductors principally of tungsten wire wrapped with smaller diameter tungsten support wire, with the lead conductors extending from within said heater to within a transition connector, and with each lead conductor insulated individually with alumina beads for at least part of the lead arrangement between but not within the heater and the transition connector; the lead conductors being connected within the transition connector to other lead wires which extend therefrom, and within the heater to a heater wire;

support means parallel to the insulated lead conductors, said support means comprising a solid attaching wire of a material selected from the group consisting of tungsten and molybdenum, with a diameter greater than the inner diameter but smaller than the outer diameter of the alumina beads;

and an outer sheath of heat-resistant metal around the insulated conductors and the attaching wire, wherein between the heater and the transition connector the lead arrangement has an overall diameter of less than one fourth inch with some flexibility, while being protected from mechanical or heat damage;

wherein said attaching wire has one end which is outside of said sheath and attached to said heater, and another end which is outside of said sheath and attached to the transition connector.

2. A lead arrangement according to claim 1, wherein said metal for said sheath is nickel in the form of a ribbon wrapped helically.

3. A lead arrangement according to claim 2, wherein said heater includes an insulating body means and a metal case means enclosing the insulating body, with a first hole extending through the metal case means, and two smaller holes extending into the the insulating body means;

and wherein said lead arrangement further includes an exit insulator with a portion within said first hole, and a portion extending outside of the heater, the exit insulator having two holes extending through both said portions and aligned with said holes in the insulating body;

wherein each lead conductor extends through one of the holes of the insulating body, then through one of the holes of the exit insulator, then through said alumina beads up to the transition connector; and wherein said sheath extends over said portion of the exit insulator outside of the heater.

* * * * *